US006089500A

United States Patent [19]

Häfner

[11] Patent Number: 6,089,500

[45] Date of Patent: Jul. 18, 2000

[54] COLLAPSIBLE WINDING SPOOL HAVING A BAYONET COUPLING BETWEEN THE HUB AND THE FLANGE

[75] Inventor: Manfred Häfner, Leopoldshöhe, Germany

[73] Assignee: Häfner & Krullmann GmbH, Leopoldshöhe, Germany

[21] Appl. No.: 09/447,766

[22] Filed: Nov. 23, 1999

[30] Foreign Application Priority Data

Dec. 14, 1998 [DE] Germany ..... 298 22 211

[51] Int. Cl.[7] ..... B65H 75/14; B65H 75/18

[52] U.S. Cl. ..... 242/608.5; 242/118.6

[58] Field of Search ..... 242/608.5, 609.3, 242/118.6, 118.61

[56] References Cited

U.S. PATENT DOCUMENTS

| | | | |
|---|---|---|---|
| 2,126,993 | 8/1938 | Howsam | 242/118.6 |
| 2,691,491 | 10/1954 | Thalhammer | 242/608.5 X |
| 2,744,694 | 5/1956 | Murray | 242/118.6 |
| 2,846,160 | 8/1958 | Thomason | 242/608.5 |
| 4,289,282 | 9/1981 | Kohno | 242/608.5 |
| 5,114,089 | 5/1992 | Posso | 242/118.6 X |
| 5,593,108 | 1/1997 | Eck et al. | 242/118.6 X |
| 5,911,378 | 6/1999 | Plestan | 242/609.3 X |

FOREIGN PATENT DOCUMENTS

| | | |
|---|---|---|
| 0 411 987 | 2/1991 | European Pat. Off. . |
| 0 411 987 A1 | 2/1991 | European Pat. Off. . |
| 79 35 978 | 5/1980 | Germany . |
| 79 35 978 U1 | 5/1980 | Germany . |
| 5-229740 | 7/1993 | Japan . |
| 6723 | 4/1895 | United Kingdom . |
| WO/94/13569 | 6/1994 | WIPO . |
| WO/94/13570 | 6/1994 | WIPO . |
| WO 94/22755 | 10/1994 | WIPO . |

*Primary Examiner*—Donald P. Walsh
*Attorney, Agent, or Firm*—Henry M. Feiereisen

[57] ABSTRACT

A winding spool, includes a hollow barrel having at least one flange which is detachable mounted to one end of the barrel by means of a bayonet coupling which includes a plurality of locking elements and retaining elements connected to the barrel end and an inside wall of the flange, respectively, and so interacting with one another that the flange can be attached to the barrel end and secured thereto by twisting the flange relative to the barrel until reaching a stop constituting a lock position of the bayonet coupling. The retaining elements and the locking elements are formed with bores which are in alignment when the bayonet coupling occupies the lock position. In alignment of the bores, a plug member can be inserted in axial direction of the spool to thereby realize a securement of the lock position of the bayonet coupling.

6 Claims, 4 Drawing Sheets

COLLAPSIBLE WINDING SPOOL HAVING A BAYONET COUPLING BETWEEN THE HUB AND THE FLANGE

CROSS-REFERENCES TO RELATED APPLICATIONS

This application claims the priority of German Patent Application Serial No. 298 22 211.6, filed Dec. 14, 1998, the subject matter of which is incorporated herein by reference.

BACKGROUND OF THE INVENTION

The present invention relates, in general, to a winding spool, and more specifically to a winding spool of a type including a hollow barrel with two flanges, whereby at least one of the flanges is detachably connected to the barrel by a bayonet coupling in the form of interacting retainer elements and locking elements formed on the barrel end and the inner flange wall, respectively, and so spaced apart as to allow interlocking of the detachable flange and the barrel end when rotating the bayonet coupling until reaching a lock position defined by a stop.

Winding spools of this type can be wound with materials of all kinds, especially wires, ropes, cables and the like and have been known for many years, for example, from International Patent Specification Nos. WO 9413569, WO 9413570, European Pat. No. EP 0 411 978 or German Pat. No. DE 79 35 978 U1. In conjunction with conical barrels or barrels that can be disassembled, the use of a separable attachment of at least one of the flanges to the barrel is advantageous because it reduces the need for space during transport of empty winding spools, in particular when the spools are returned by the consumer back to the provider for re-winding new material onto the barrel.

In certain situations, it may be desirable to temporarily secure the bayonet coupling by an additional locking mechanism, in particular when encountering during take-up phase and unwinding phase sudden accelerations or decelerations, in order to prevent a rotation between the flange and the barrel in release direction of the bayonet. Known constructions propose integration of latching members in the flange or the barrel for engagement into the gap of the bayonet coupling, i.e. between two locking elements or two retaining elements. When the flange and the barrel end are fitted into one another, the latching members are resiliently forced back, and spring back into the gaps when the bayonet coupling reaches the lock position to thereby secure the bayonet coupling against release.

Integration of such latching members is complicated in structure and expensive as far as production and installation in the flange are concerned. Moreover, in many cases, the securement between flange and barrel in axial direction of the winding spool by means of the bayonet coupling is sufficient, so that the use of such integrated locking members is not needed.

SUMMARY OF THE INVENTION

It is thus an object of the present invention to provide an improved winding spool, obviating the afore-stated drawbacks.

In particular, it is an object of the present invention to provide an improved winding spool which is simple in structure and universally applicable.

These objects, and others which will become apparent hereinafter, are attained in accordance with the present invention by providing a bayonet coupling for detachably mounting a flange to one end of a barrel, with the bayonet coupling including a plurality of locking elements and retaining elements connected to the barrel end and an inside wall of the flange, respectively, and so interacting with one another that the flange can be attached to the barrel end and secured thereto by rotating the flange relative to the barrel until reaching a stop constituting a lock position of the bayonet coupling, whereby interacting retaining elements and locking elements have bores which are in alignment when the bayonet coupling occupies the lock position; and by providing a plug member which is insertable in axial direction of the spool in the bores when the bores are in alignment.

A winding spool in accordance with the present invention is simple in structure as the plug member can easily be manufactured and the formation of bores in the retaining elements and locking elements is simple to carry out. The design of this additional safeguard mechanism for the bayonet coupling to prevent inadvertent release can be provided only for those situations that make their use sensible, so that the winding spool according to the invention is universally applicable.

According to another feature of the present invention, the plug member is formed with a plate-shaped head portion which can so interact with the bore in the retaining elements that a free space is formed between the retaining element and the head portion to permit a withdrawal of the plug member. Suitably, the plug member has one end formed with at least one slot and includes a peripheral bead defining a ledge surface which can hook under the bottom side.

BRIEF DESCRIPTION OF THE DRAWING

The above and other objects, features and advantages of the present invention will be more readily apparent upon reading the following description of a preferred exemplified embodiment of the invention with reference to the accompanying drawing, in which.

DETAILED DESCRIPTION OF PREFERRED EMBODIMENTS

Figure 1:
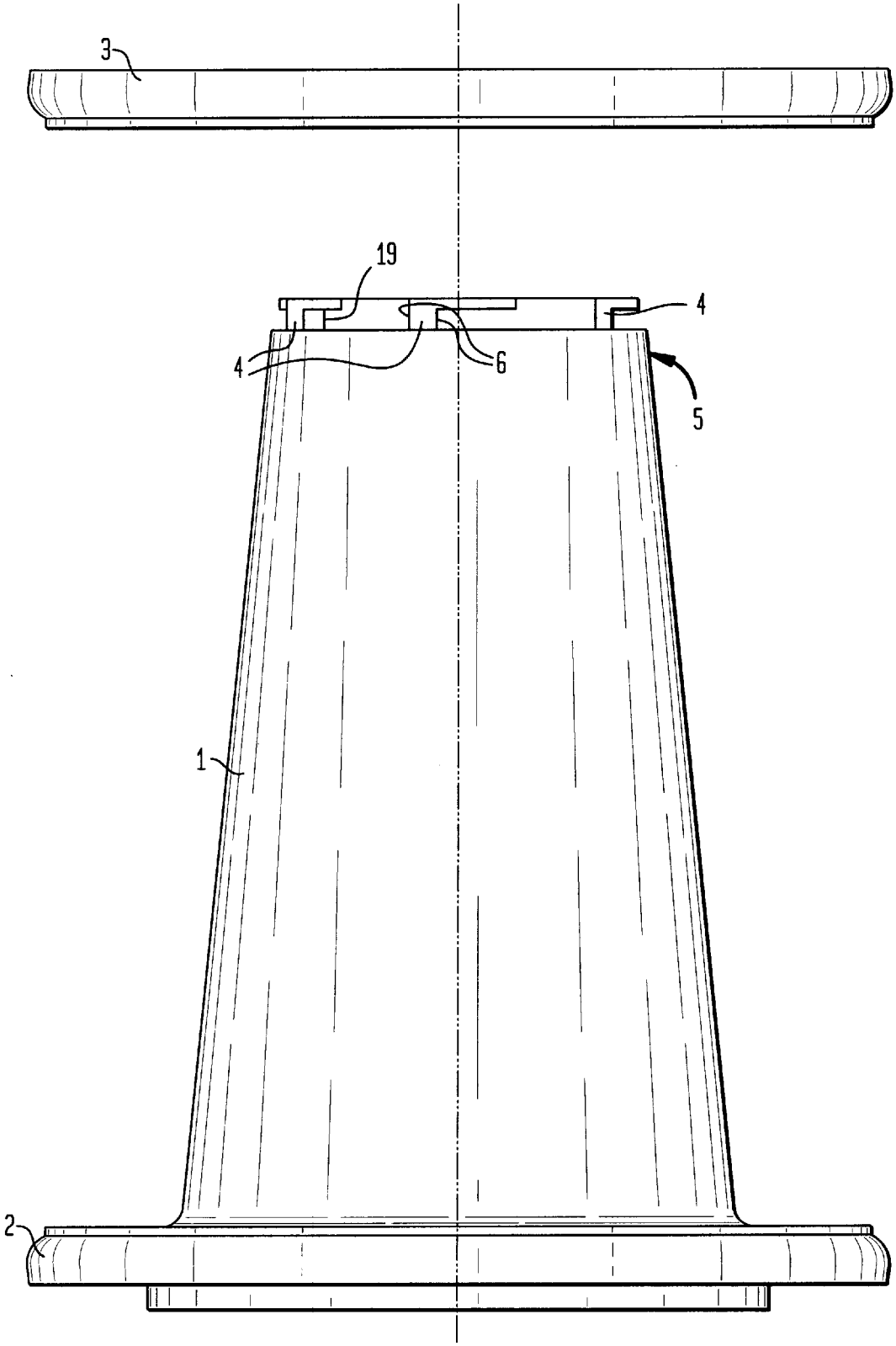
FIG. 1 is a schematic side view in exploded illustration of a winding spool according to the present invention.

Throughout all the Figures, same or corresponding elements are generally indicated by same reference numerals.

Turning now to the drawing, and in particular to FIG. 1, there is shown a schematic side view in exploded illustration of a winding spool according to the present invention, including a generally conical barrel 1 for winding and unwinding a material. In the nonlimting example of FIG. 1, the barrel 1 is hollow and is bounded on its opposite ends by two disk-shaped flanges 2, 3. As shown in FIG. 1, the flange 3 is detachably securable to the respective barrel end of relative smaller diameter while the other flange 2 is formed integrally with the barrel 1 at the other barrel end of relative greater diameter. Suitably, both flanges 2, 3 may be reinforced by radial ribs and ring-shaped webs in concentric relation to the center of the flanges.

Persons skilled in the art will understand that it is certainly within the scope of the present invention to have only flange 2 or to have both flanges 2, 3 detachably securable to the barrel 1 without departing from the general concept outlined here by this disclosure. It will further be appreciated by persons skilled in the art that the barrel may have a cylindrical configuration and so designed that the barrel 1 can be dismantled.

The separable connection between the flange 3 and the respective end of the barrel 1 is realized by a bayonet coupling which includes retaining elements 4 spaced about the inside perimeter of the barrel 1 at the respective barrel end. The retaining elements 4 project out from a ring structure 7 toward the confronting inside wall surface 5 of the barrel end of the hollow barrel 1 and are formed on one end with a bridge 6 which supports the ring structure 7 and slightly extends beyond the end face of the retaining elements 4 for integral attachment to the inside wall 5 of the barrel 1, as shown in particular in FIG. 2. Each retaining element 4 thus exhibits with the pertaining bridge 6 a 900 rotated L-shaped configuration at formation of a spacing 19. The ring structure 7, which has an outer diameter that is smaller than the diameter of the associated end of the barrel 1, defines with its inner wall a receptacle 8 for a winding shaft of a winding and unwinding device (not shown) such that the receptacle 8, which is conical at least in predetermined regions, applies the winding and unwinding forces directly centrically onto the barrel 1 of the winding spool to thereby prevent a transmission of theses forces onto the detachable flange 3 and the bayonet coupling.

Figure 2:
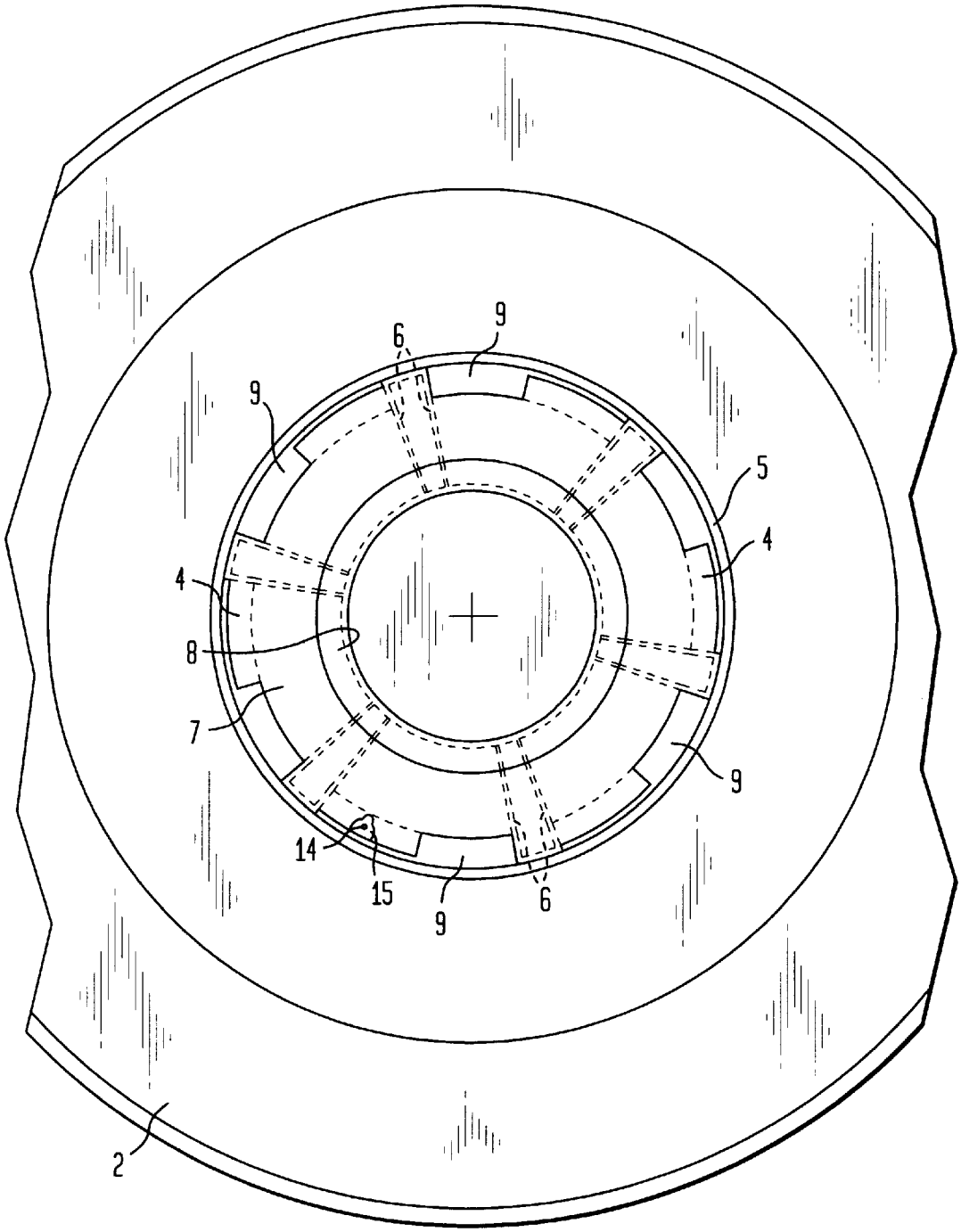
FIG. 2 is a top plan view of the winding spool, showing the barrel end for attachment by a separable flange.
Figure 3:
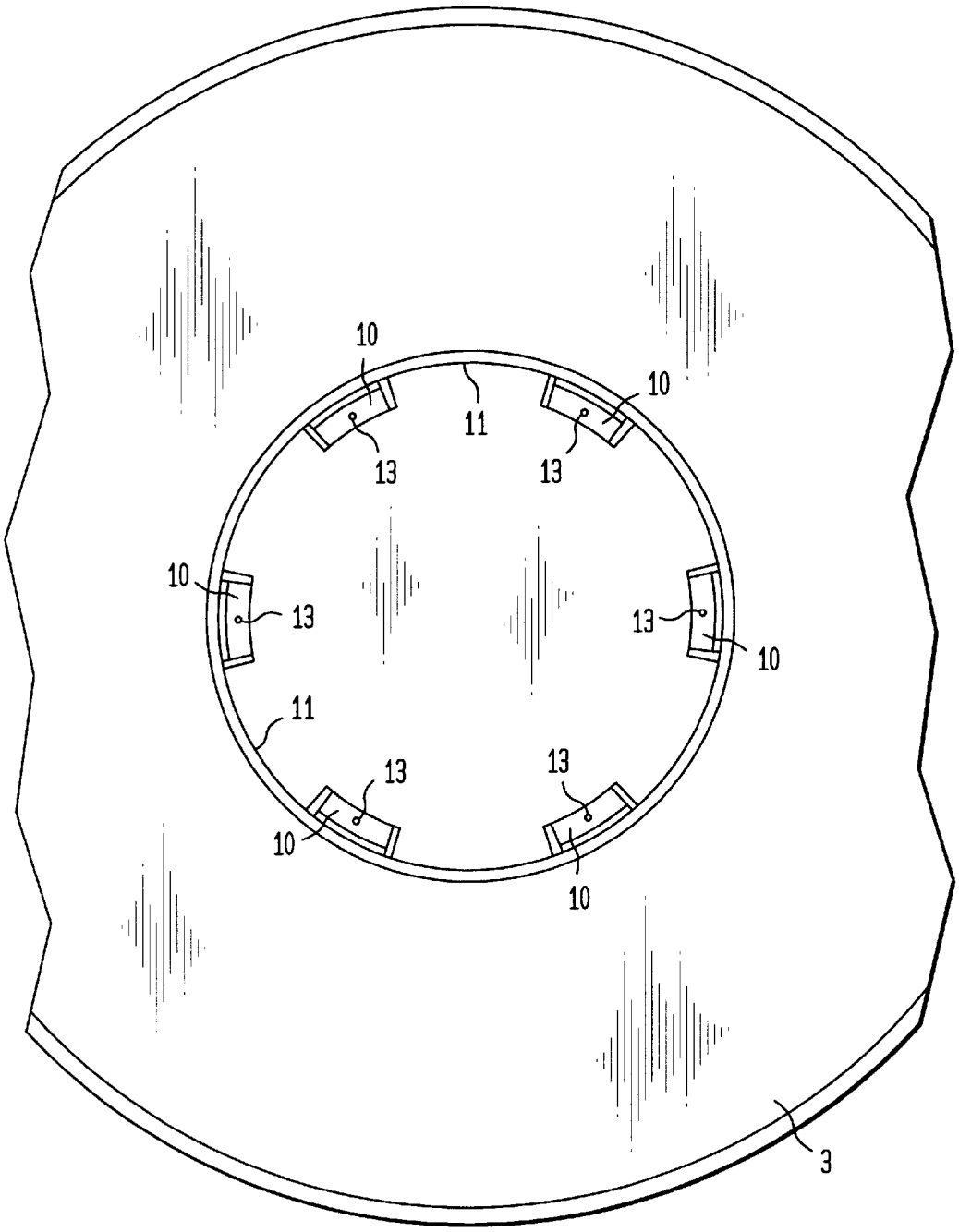
FIG. 3 is a bottom view of the separable flange.

As best seen in FIG. 2, the retaining elements 4 are so spaced about the circumference of the ring structure 7 that gaps 9 are formed for cooperation with locking elements 10 which form another part of the bayonet coupling. The locking elements 10 are formed in spaced-apart disposition about the circumference of the flange 3 and project inwardly from the inside wall 11 of the flange 2, as shown in FIG. 3.

Attachment of the flange 3 to the barrel 1 is as follows: The flange 3 is positioned with respect to the barrel 1 such that the locking elements 10 are in alignment with the gaps 9 between the retaining elements 9. Subsequently, the flange 3 inserted and rotated underneath the retaining elements 4 in the spacings 19 into the lock position of the bayonet coupling until the locking elements 10 are seated firmly. The bridges 6 of the retaining elements 4 thereby form stops to indicate an end for the rotation of the flange 3 and define the lock position of the bayonet coupling. In the lock position, the barrel 1 and the detachable flange 3 are securely fixed to one another in axial direction of the winding spool.

In order to provide a safeguard against detachment of the flange 3 from the barrel 1 and thus to permit use of the winding spool also for those situations in which an additional securement of the bayonet coupling in the lock position against inadvertent rotation in release direction is appropriate, the locking elements 10 are each formed with a bore 13 (c.f. FIG. 3) and at least one of the retaining elements 14 is formed with a bore 14 (cf. FIG. 2) which is in alignment with the bore 13 of one of the locking elements 10 when the bayonet coupling occupies the lock position.

Figure 4:
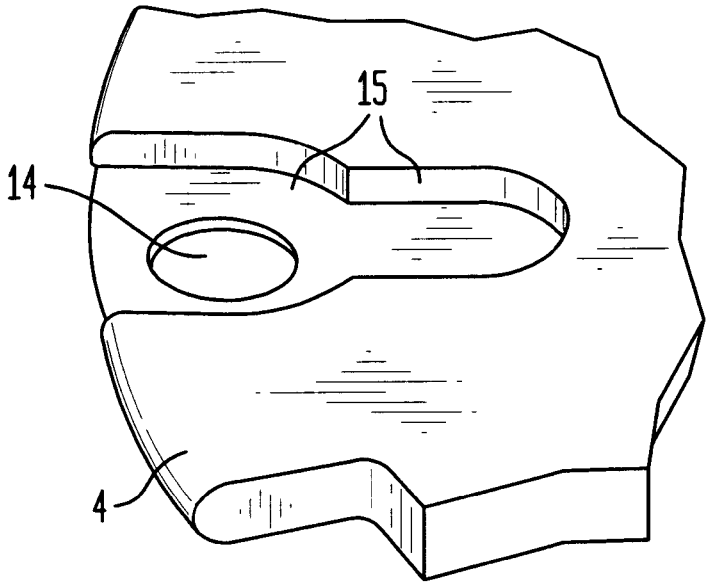
FIG. 4 is a cutaway perspective illustration of the barrel end, showing in detail a retaining element.
Figure 5:
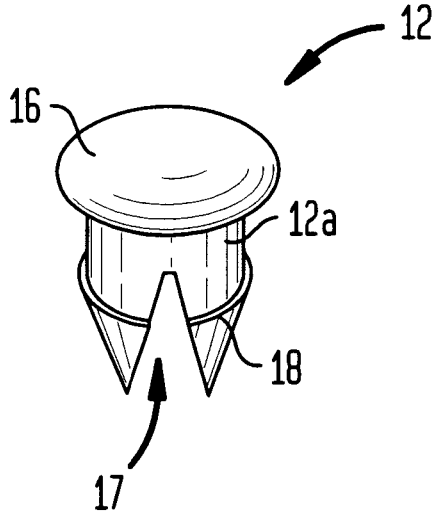
FIG. 5 is a perspective view of a plug member.

As shown in particular in FIG. 4, the bore 14 of the retaining element 4 extends from the bottom side of the retaining element 4 and terminates in a counterbore 15 which is formed in the top surface of the retaining element 4. When the flange 3 is rotated into the lock position of the bayonet coupling, a plug member, generally designated by reference numeral 12 and shown in FIG. 5, is insertable through the aligned bores 13, 14 between the respective locking element 10 and the retaining element 4. The plug member 12 has a shank 12*a* which terminates at one end in a head plate 16 of greater diameter and has an opposite head plate distal end of pointed configuration. Extending inwardly from the pointed end, the shank 12*a* of the plug member 12 is provided with at least one slot 17, preferably several slots 17, to provide the plug member 12 with a certain flexibility. At a distance to the pointed end, the shank 12*a* is formed with a peripheral bead to define a ledge surface 18. Thus, the insertion of the plug member 12 in the aligned bores 13, 14 is facilitated by the slight deformation of the shank 12 as a consequence of its flexibility. Once the shank 12*a* is placed through the aligned bores 13, 14, the ledge surface 18 snaps behind the underside of the bayonet coupling adjacent to the bore 13, with the head plate 16 being supported by the counterbore 15.

The counterbore 15 has a contour so configured and sized that a free space remains between the head plate 16 of the plug member 12 and the top surface of the retaining element 4 so that the plug member 12 can easily be removed by using a narrow tool which engages underneath the head plate 16.

The formation of each locking element with a bore 13, as shown in FIG. 3, represents only a preferred embodiment which ensures that the flange 3 can be placed onto the barrel 1 at any desired disposition. Although, FIG. 2 shows only one of the retaining elements 4 formed with a bore 14, it is certainly within the scope of the present invention, to provide several or all of the retaining elements with such bores to permit optional use of several plug members. It is also conceivable to secure the plug member by means of a thread, small wire or a highly elastic film strap hinge to, for example, the flange 3 or the barrel 1.

While the invention has been illustrated and described as embodied in a winding spool, it is not intended to be limited to the details shown since various modifications and structural changes may be made without departing in any way from the spirit of the present invention.

What is claimed as new and desired to be protected by Letters Patent is set forth in the appended claims:

1. A winding spool; comprising:

a hollow barrel having opposite ends and defined by an axis;

a pair of flanges;

a bayonet coupling for detachably mounting at least one of the flanges to one end of the barrel, said bayonet coupling including a plurality of spaced-apart retainer elements and a plurality of spaced-apart locking elements respectively connected to the one end of the barrel and an inside wall of the at least one flange, and so interacting with one another that the at least one flange is attachable to the one end of the barrel and securable by rotating the at least one flange relative to the barrel until reaching a stop constituting a lock position of the bayonet coupling, wherein at least one of the retaining elements is formed with a bore and at least one of the locking elements is formed with a bore, said bore of the at least one retaining element and said bore of the at least one locking element being in alignment when the bayonet coupling occupies the lock position; and a plug member insertable in a direction of the axis in the bores when the bores are in alignment.

2. The winding spool of claim 1 wherein the at least one flange includes the locking elements, with each one of the locking elements formed with a said bore.

3. The winding spool of claim 1 wherein the retaining elements are connected to the barrel, said at least one retaining element having a top side, said bore of the at least one retaining element terminating in a counterbore on the top side of the at least one retaining element.

4. The winding spool of claim 1 wherein the plug member is formed with a plate-shaped head portion.

5. The winding spool of claim 3 wherein the plug member is formed with a plate-shaped head portion, said counterbore being so configured and sized that the plug member is insertable therein at formation of a free space to permit withdrawal of the plug member via the head portion.

6. The winding spool of claim 1 wherein the plug member has one end formed with at least one slot and including a bead defining a ledge surface.

* * * * *